United States Patent [19]

Didchenko et al.

[11] Patent Number: 4,740,291

[45] Date of Patent: Apr. 26, 1988

[54] UPGRADING OF PYROLYSIS TAR USING ACIDIC CATALYSTS

[75] Inventors: Rostislav Didchenko, Middleburg Heights; Eric M. Dickinson, Bay Village, both of Ohio

[73] Assignee: Union Carbide Corporation, Danbury, Conn.

[21] Appl. No.: 684,139

[22] Filed: Dec. 20, 1984

[51] Int. Cl.[4] ..... C10G 45/00; C10G 9/14

[52] U.S. Cl. ..... 208/89; 208/40; 208/44; 208/50; 208/57; 208/111; 208/131

[58] Field of Search ..... 208/89, 44, 50, 131, 208/111, 40, 57

[56] References Cited

U.S. PATENT DOCUMENTS

| | | | |
|---|---|---|---|
| 3,773,653 | 11/1973 | Nongbri et al. | 208/89 |
| 3,781,198 | 12/1973 | Wynkoop et al. | 208/89 |
| 3,817,753 | 6/1974 | Folkins | 208/50 |
| 4,101,416 | 7/1978 | Dolber | 208/57 |
| 4,213,846 | 7/1980 | Soöter et al. | 208/131 |
| 4,235,703 | 11/1980 | Kegler et al. | 208/131 |
| 4,312,742 | 1/1982 | Hayashi | 208/50 |
| 4,358,361 | 11/1982 | Peters | 208/89 |
| 4,358,366 | 11/1982 | Alford et al. | 208/50 |
| 4,394,250 | 7/1983 | Grossberg | 208/50 |
| 4,466,883 | 8/1984 | Eickemeyer et al. | 208/89 |
| 4,490,244 | 12/1984 | Stecker | 208/131 |
| 4,576,709 | 3/1986 | Miller et al. | 208/57 |

FOREIGN PATENT DOCUMENTS

| | | | |
|---|---|---|---|
| 90897 | 10/1983 | European Pat. Off. | 208/44 |
| 867889 | 5/1961 | United Kingdom | 208/44 |

*Primary Examiner*—Helen M. S. Sneed
*Assistant Examiner*—Helane Myers
*Attorney, Agent, or Firm*—James L. Sonntag

[57] ABSTRACT

Pyrolysis tars are upgraded by hydrotreatment thereof in the presence of an acidic catalyst. The treated pyrolysis tars are used to produce premium cokes useful in the production of graphite electrodes.

15 Claims, No Drawings

UPGRADING OF PYROLYSIS TAR USING ACIDIC CATALYSTS

RELATED APPLICATIONS

This application is related to concurrently filed U.S. application Ser. No. 684,140 by E. Dickenson and R. Didchenko.

FIELD OF THE INVENTION

The invention relates to the production of premium coke suitable for use in the production of graphite electrodes, particularly to a process for producing a premium coke from pyrolysis tar.

More particularly the invention relates to the upgrading of pyrolysis tar under hydrotreatment conditions using an acidic catalyst such that the pyrolysis tar can be used to produce a premium coke.

BACKGROUND OF THE INVENTION

Premium coke is well known in the art and is a commercial grade of coke having acicular, and anisotropic microstructure.

Premium cokes are used in the production of electrode grade graphite which requires that the coke have certain qualities. For example, a graphite electrode to be used in the arc melting of steel or the like must possess a low value for the coefficient of thermal expansion (CTE), particularly in the longitudinal direction, because of the severe thermal shocks which occur in such processes. The premium coke used for producing the graphite electrode must be capable of imparting a low CTE to the electrode.

In the process for producing a graphite electrode, a carbon body is formed from a premium coke and the carbon body is heated to between about 2000° C. and about 3000° C. in order to provide energy to convert the carbon in the coke to a graphite crystalline form and to volatilize impurities. When a carbon body made from a coke is heated to temperature in the range of from about 1000° C. to about 2000° C., various sulfur-containing compounds, which may be present in the coke, decompose, which often results in a rapid expansion and possible breakage of the carbon body. This phenomenon is termed "puffing". It is desirable to use a precursor containing a low amount of sulfur material for producing the premium coke in order to minimize or preferably eliminate problems due to "puffing".

Typically, commercially produced premium cokes are made from aromatic, slowly reacting feedstocks of low sulfur content, such as decant oils from catalytic cracking and tars obtained from the thermal cracking of decant oils and gas oils.

The presently used feedstocks are satisfactory, but it would be desirable to use pyrolysis tars as feedstocks for producing premium cokes, because pyrolysis tars are relatively inexpensive mixtures of aromatic compounds and most of these tars have a low sulfur content. Generally, large amounts of pyrolysis tars are made as heavy by-products in the steam cracking of petroleum feedstocks to produce monomers, in particular ethylene, for the plastics industry.

Because of the high aromatic content and the low sulfur content, pyrolysis tars would appear to be suitable feedstocks for the formation of premium coke, but they are generally unsuitable. Most pyrolysis tars are highly reactive, which causes problems in the delayed coking process, which is the process generally used to produce premium cokes. In this process, the pyrolysis tars have a tendency to convert to coke in the coils of the delayed coke furnace under typical operating conditions. This results in clogging of the furnace, short operating periods, and excessive down time to clean the furnace coils. Another disadvantage is that cokes produced from pyrolysis tars are generally not premium cokes, that is they impart an undesirably large longitudinal CTE to graphite electrodes made therefrom. For these reasons, most pyrolysis tars are unsuitable for the production of premium coke.

H. O. Folkins in U.S. Pat. No. 3,817,753 discloses a method for upgrading pyrolysis tars by treating pyrolysis tars with hydrogen in the presence of a conventional hydrodesulfurization catalyst. The catalysts are described as having a hydrogenation component on an inert carrier. Pyrolysis tars can be upgraded to some extent by the treatment with hydrogen in a Folkins process. However, there is an undesirably high consumption of costly hydrogen and large losses in the final yield of coke. Furthermore, as shown in his Table 2, the CTE values for the cokes produced by the pyrolysis tars treated by the Folkins process ($1.58\times10^{-6}$/°C. and above) are unacceptably high for premium coke, which has a CTE below about $0.55\times10^{-6}$/°C.

Hayashi, et al. in U.S. Pat. No. 4,312,742 discloses the treatment of various feedstocks, including pyrolysis tars, with hydrogen in the absence of a catalyst under gradual heating to 350° C. to 400° C. They show the production of a final coke product with a marginally acceptable CTE. There is no disclosure of the CTE for the starting material or that the pyrolysis tar was upgraded by the Hayashi, et al. process. Furthermore, the process disclosed by Hayashi, et al. involves a gradual heating which would generally be commercially unacceptable because of the process time involved.

It is, therefore, an object of the invention to provide a method for upgrading pyrolysis tars such that they are suitable for the making of premium coke.

It is also an object of the invention to provide a method for the upgrading of pyrolysis tars with a low or negative consumption of hydrogen.

It is also an object of the invention to provide a method for the upgrading of pyrolysis tars without a high loss of the yield of coke.

It is also an object of the invention to provide a method for producing premium coke that imparts a low CTE to a graphite electrode.

SUMMARY OF THE INVENTION

In its broadest aspect, the invention contemplates a method for upgrading a pyrolysis tar used to form coke which comprises hydrotreating a pyrolysis tar feed in the presence of an acidic catalyst having at least about 65 micromoles of acid sites per gram catalyst, wherein the acid sites per gram are measured by the ammonia adsorption/TGA method at about 400° C. after calcination of the catalyst at 500° C. During the hydrotreatment hydrogen is produced and drawn off.

By practice of the invention it is possible to form a premium coke, a coke that imparts a longitudinal CTE not greater than about $0.55\times10^{-6}$/°C. to a graphite artifact made from the coke.

Also within contemplation of the invention is a method for producing premium coke which comprises subjecting the above treated pyrolysis tar to destructive distillation conditions to form a coke.

The method of the invention is most effective in the upgrading of pyrolysis tars which, without treatment, form marginal cokes or cokes that are not premium cokes but are marginally acceptable from a commercial standpoint. A marginal coke is a coke that imparts a longitudinal CTE between about $0.55\times10^{-6}$/°C. and about $0.7\times10^{-6}$/°C. to a graphite artifact made from the coke. It was found that treatment by the process of the invention of pyrolysis tars that produce cokes that are not even of marginal coke quality, that is cokes that impart a longitudinal CTE greater that about $0.7\times10^{-6}$/°C., is not always effective in upgrading the pyrolysis tar. For this reason, it is preferred that the starting pyrolysis tar be at least of the marginal coke quality, that is the pyrolysis tar should produce a coke that imparts a longitudinal CTE not greater than about $0.7\times10^{-6}$/°C. to a graphite artifact made from the the coke.

By practice of the invention it is possible to upgrade a pyrolysis tar, that is, the coke produced from the treated pyrolysis tar imparts a significantly lower CTE to a graphite artifact than the coke produced from the untreated pyrolysis tar. By practice of the invention it is possible to produce premium coke from pyrolysis feedstocks, which formerly could only produce cokes that were at best marginally acceptable to be used in the manufacture of graphite electrodes.

Without being bound to any theory, it is believed that the acidic catalyst used in the process of the invention results in beneficial rearrangements of the more reactive molecules in the pyrolysis tar, resulting in an upgraded pyrolysis tar, without the above described problems. It also believed that the rearrangement of the more reactive species lowers the reactivity of the tars to an extent such that the problem of coking in the coils of delayed coking furnaces are alleviated.

The acidic catalyst promotes the dehydrogenation or aromatization of hydroaromatic rings in addition to causing molecular rearrangements. During practice of the invention there is a net loss of hydrogen from the pyrolysis tar, resulting in hydrogen production. It is, therefore, possible to produce material from pyrolysis tar that can be used as a feedstock in the production of premium coke, without the expensive consumption of hydrogen.

In the prior art processes such as that of Folkins, described above, the principal reaction is the addition of hydrogen to the aromatic rings. In addition to the undesirable consumption of hydrogen, the final yield of coke is significantly reduced due to the reduction of the aromatic ring content.

However, in the present method, the molecules are rearranged and the hydrogen redistributed in a manner that does not significantly lower the aromatic ring content, and thus lower the final yield of premium coke to as high a degree.

The untreated pyrolysis tar is treated in the presence of a catalyst having sufficient acid activity to result in the desirable molecular rearrangements and low hydrogen consumption, which is a catalyst having at least about 65 micromoles per gram of acid sites at 400° C., after calcination of the catalyst at 500° C. Use of catalysts having fewer acid sites will not provide the full benefits achievable by practice of the invention. At about 65 micromoles of acid sites per gram catalyst and above, the favorable molecular rearrangement and upgrading of the pyrolysis tar occurs, as shown in Example II. The upgrading of the pyrolysis tar with acidic catalysts is also shown in the examples of the above cited U.S. application Ser. No. 684,140, wherein an acidic catalyst having a hydrogenation component and an acidic component at a level greater than 65 micromoles acid sites per gram catalyst is used to upgrade pyrolysis tars.

DESCRIPTION OF THE INVENTION

For purposes of this specification a "premium coke" is defined as a coke which, after calcination to 1000° C., can be made into a graphite artifact having a CTE in the longitudinal direction not greater than about $0.55\times10^{-6}$/°C. Cokes which can be made into graphite artifacts having a CTE between about $0.55\times10^{-6}$/°C. and $0.7\times10^{-6}$/°C., are considered marginally acceptable as premium cokes and are referred to herein as "marginal cokes". Cokes which can be made into graphite artifacts having a CTE greater than about $0.7\times10^{-6}$/°C. are considered unacceptable as premium cokes and are referred to herein as "non-premium cokes". The CTE is measured over the temperature range of about 30° C. to about 100° C.

Pyrolysis tars are residual by-products from olefin plants. In a typical processes wherein pyrolysis tars are produced, petroleum feedstocks, such as naphtha condensates, gas oils, and/or low-boiling hydrocarbons such as ethane and propane, are thermally cracked to produce mainly ethylene, some propylene, and perhaps amounts of butene and acetylene. The thermal cracking is typically carried out at a temperature between about 650° C. and about 980° C. in the presence of a diluent gas, such as steam, at pressures between about 100 and 200 kilopascals. A by product of these cracking processes are high-boiling point residues, or pyrolysis tars.

Preferably, the pyrolysis tar to be treated by the process of the invention is capable of producing a marginal coke or a premium coke, most preferably a marginal coke. Pyrolysis tars capable of producing a premium coke are also suitable, although the benefit of upgrading such a tar is smaller. Some nonpremium cokes may not be upgraded by practice of the invention and are, therefore, not preferred.

Preferably the pyrolysis tars used in the process of the invention have a sulfur content less than about 0.8 wt.% weight percent, preferably less that about 0.5 wt.%, based on the total weight. Most pyrolysis tars have such low sulfur contents, since the olefin production processes from which they are generally produced usually incorporate feedstock desulfurization treatment.

In the process of the invention, the pyrolysis tar is upgraded by hydrotreating the tar in the presence of the acidic catalyst. As used herein, "hydrotreating" means treatment in the presence of hydrogen at a temperature and a pressure sufficient to bring about the upgrading of the pyrolysis tar. Typically, the pressure is between about 3.4 and about 13.8 megapascals (500–2000 psi), preferably between about 5.2 and about 10.3 megapascals (750–1500 psi). The temperature is typically between about 260° C. and about 425° C., preferably between about 290° C. and about 370° C.

The method of the invention is carried out over an acidic catalyst having sufficient acid activity to produce an upgraded pyrolysis tar capable of producing premium coke. When a catalyst having no or little acidity (below about 65 micromoles of acid sites per gram of catalyst) is used the result is either an excessive consumption of hydrogen, as when a hydrogenation catalyst is used, and/or there is no upgrading of the pyrolysis tar. Suitable catalysts are those having an acidity (measured by the number of acid sites) of at least 65 micromoles of acid sites per gram of catalyst, wherein the measurement is at 400° C. Weights are based on samples that have been calcined to 500° C. before measurement. The total number of acid sites can be measured by the ammonia adsorption/TGA method. The ammonia adsorption/TGA method is described in "Solid Acids and Bases", by K. Tanabe, Academic Press, 1970, p. 21.

Examples of suitable acid catalysts include catalysts having, as an acidic component, known solid acids such as sulfated zirconia, acidic aluminas (e.g., gamma aluminas, and halogenated aluminas), clay-like alumino-silicates and silica-alumina gels, as well as crystalline alumina-silicates (e.g., zeolites). Typically the aluminas and alumino-silicates are steam activated.

The treated pyrolysis tars may be transformed into coke by well known methods of subjecting the pyrolysis tar to elevated temperatures in an oxygen poor atmosphere to destructively distill off the volatile components. For example, treated pyrolysis tars can be transformed into coke as illustrated in the examples below.

The invention will now be illustrated by the following examples, which are not intended to be limitive of the invention.

The pyrolysis tars in the examples below were formed into coke by heating in a laboratory autoclave at 50° C. per hour to a temperature of 650° C., and maintaining this temperature for 5 hours at a pressure of 100 psig (0.69 megapascals gauge).

For each catalyst sample, the number of acid sites were measured using the ammonia adsorption/TGA method using 500° C. calcined samples.

The cokes in each of the examples below were used to produce graphite electrodes in accordance with conventional testing procedures, as follows:

The raw cokes from each test were calcined to 1000° C. and then crushed and milled to a flour such that 55%±10 wt.% passed through a 200 mesh Tyler screen. The flour was mixed with coal tar pitch binder and extruded into 19 mm diameter rods and processed into graphite according to standard procedures for producing graphite electrodes. The graphitization was carried out until a temperature of about 3000° C. was reached.

The longitudinal CTE of each rod was measured in the temperature range of from about 30° C. to about 100° C.

Hydrogen volumes given below are at 0° C. and 1 atm. (101 kpa).

EXAMPLE I

This is a comparative example illustrating a process wherein a hydrogenation catalyst, one having negligible acidic activity, was used in the treatment of pyrolysis tars. The catalyst was similar to those described in the above-cited U.S. Pat. No. 3,817,853 and consisted essentially of a cobalt and molybdenum hydrogenation component on an inert alumina carrier. This catalyst is available commercially from Nalco Chemical Company, Oak Brook, Ill. under the commercial name of Nalco TM 477. This catalyst had a total acidity of about 46 micromoles of acid sites per gram catalyst at 400° C., as measured by the ammonia adsorption/TGA method. It comprised 5 wt.% CoO, 15 wt.% $MoO_3$, and 80 wt.% gamma-alumina. The bulk density was 0.701 g/cc, the surface area was 250 $m^2/g$, the pore volume was 0.55 cc/g, and the average pore diameter was 90 Angstrom units.

The pyrolysis tar (Pyrolysis Tar PT-1) treated was derived from the steam-cracking of a mixture of naphtha and gas oil, and had the properties shown in Table A. Average molecular weight is the number average molecular weight measured by vapor phase osmometry in pyridine at 86° C.

TABLE A

| Properties of Pyrolysis Tar PT-1 | |
|---|---|
| Gravity, °API | −4.7 |
| Average Mol. Wt. | 350.0 |
| Sulfur, Wt. % | 0.26 |
| Carbon, Wt. % | 91.9 |
| Hydrogen, Wt. % | 7.5 |
| Conradson Carbon, Wt. % | 20.0 |
| Initial Boiling Point, °C. | 190.0 |
| 50% Boiling Point, °C. | 410.0 |
| 75% Boiling Point, °C. | 510.0 |

The pyrolysis tar was reacted in the presence of hydrogen over the hydrogenation catalyst in a flow reactor. The reactor was a trickle bed concurrent type and had a volume of 300 cubic centimeters, and contained 100 cubic centimeters of catalyst and 200 cubic centimeters of inert quartz chips. The reaction temperature was about 650° F. (340° C.), the liquid space velocity of the pyrolysis tar was about 1.5 hour −1 and the pressure in the reactor was about 1000 psig (6.89 megapascals gauge). Hydrogen was introduced at a rate of 2000 scf/bbl (356 cubic meters of hydrogen per cubic meter of tar feed). Hydrogen consumption was 400 scf/bbl (71 cubic meters of hydrogen per cubic meter of pyrolysis tar feed).

Samples of untreated pyrolysis tar and the hydrotreated pyrolysis tar were coked in the above laboratory autoclave, as described above, at about 100 psig (0.69 megapascals gauge) with a heating rate of 50° C. per hour to 650° C. with a 5 hour hold at 650° C. The coke was made into electrodes by the above procedure. For both the treated and untreated tar, the coke yield and the CTE of the electrodes made from each coke were measured. The results are summarized below in Table B. The coke yield is the wt. percent of the final calcined coke product relative to the weight of material coked.

TABLE B

| Treatment With Hydrogenation Catalyst | | |
|---|---|---|
| Tar | Coke Yield % | CTE ($\times 10^{-6}$/°C.) |
| Untreated | 35.6 | 0.61 |
| treated | 20.7 | 0.49 |

As can be seen, the pyrolysis tar was upgraded by the hydrotreatment, but with a large decrease in coke yield (42 percent), and a high consumption of hydrogen as compared to the practice of the invention as illustrated below. As demonstrated by Examples II and III, below, the low coke yield and the high hydrogen consumption which are inherent in the treatment of pyrolysis tar with hydrogenation catalysts can be avoided by practice of the invention.

EXAMPLE II

This example illustrates practice of the invention. Pyrolysis Tar PT-1 in Example I was reacted in the presence of hydrogen over an acidic catalyst of the invention.

The catalyst was gamma-alumina that was steam activated for 1 hour at 750° C. in 100% steam. The catalyst had a very narrow pore size distribution with most of the porosity within the range 0.006 to 0.06 microns. The acidity in terms of the total number of acid sites was 470 micromoles/gram at 200° C. and 150 micromoles at 400° C. The acidity was determined by the above-cited ammonia adsorption/TGA method.

Samples of pyrolysis tar PT-1 were treated in the presence of hydrogen over the above described acidic catalyst in the flow reactor of Example I, at similar conditions as in Example I, using 100 cubic centimeters of catalyst and 200 centimeters of quartz chips. The reaction temperature was about 650° F. (340° C.), the liquid space velocity of the pyrolysis tar was about 1.5 hour and the pressure was about 1000 psig (6.89 megapascals gauge). Hydrogen was introduced at a rate of 2000 scf/bbl (356 cubic meters hydrogen per cubic meter of tar feed). Hydrogen was produced at a rate of 500 scf/bbl (88.8 cubic meters of hydrogen per cubic meter of tar feed). Samples of treated pyrolysis tar were coked in a laboratory batch coker using the same method described in Example I and made into electrodes by the above standard procedure. For the untreated and treated tar, the coke yield and the CTE of the electrodes were measured. The results are summarized below in Table C.

TABLE C

| | Pyrolysis Tar Treatment With Acidic Catalyst | |
|---|---|---|
| Tar | Coke Yield % | CTE ($\times 10^{-6}$/°C.) |
| Untreated | 35.6 | 0.61 |
| Treated | 34.3 | 0.54 |

As seen by the above result, the pyrolysis tar, which produced only a marginal coke, was upgraded to a tar forming a premium coke. This was accomplished with a negligible loss in coke yield. Furthermore, there was a net hydrogen production, which contrasts sharply with the prior-art process of Example I.

EXAMPLE III

This is a comparative example showing treatment of the pyrolysis tar in the presence of hydrogen and no catalyst. Pyrolysis Tar PT-1 from Example I was treated as in Example I, except only 200 cubic centimeters of inert quartz chips, with no catalyst were used in the reactor. The temperature was 700° F. (371° C.). The pressure and the space velocity of the pyrolysis tar was the same as in Example I. Hydrogen was introduced at a rate of 2000 scf/bbl (356 cubic meters of hydrogen per cubic meter of tar feed). Hydrogen production was 400 scf/bbl (71 cubic meters of hydrogen per cubic meter of tar feed).

For both the treated and untreated tar, the coke yield and the CTE of the electrodes made from the coke were measured. The results are summarized below in Table D.

TABLE D

| | Treatment With No Catalyst | |
|---|---|---|
| Tar | Coke Yield % | CTE ($\times 10^{-6}$/°C.) |
| Untreated | 31.5 | 0.61 |
| treated | 31.8 | 0.79 |

The CTE for the coke from the treated tar as shown in Table D should be compared with a CTE of $0.54\times10^{-6}$/°C. for the same pyrolysis tar treated in the presence of an acidic catalyst in Example II and a CTE of $0.61\times10^{-6}$/°C. for the untreated tar. The pyrolysis tar here was actually down-graded such that it produced an unacceptable non-premium coke.

Although the invention has been described by reference to specific examples, it is understood that variations and alterations are within the spirit of the invention and they are contemplated as being included within the scope of the claims.

We claim:

1. A method for upgrading a pyrolysis tar used to form coke which comprises hydrotreating a pyrolysis tar feed in the presence of an acidic catalyst having at least about 65 micromoles of acid sites per gram of catalyst in a reaction zone, producing hydrogen while hydrotreating the pyrolysis tar feed, and discharging the hydrogen from the reaction zone, wherein the acid sites per gram are measured by the ammonia adsorption/TGA method at about 400° C. after calcination of the catalyst to 500° C.

2. The method of claim 1 wherein the catalyst comprises gamma-alumina, halogenated alumina, sulfated zirconia, non-crystalline alumino-silicate or crystalline alumino-silicate.

3. The method of claim 2 wherein the catalyst comprises steam activated gamma-alumina.

4. The method of claim 1 wherein the untreated pyrolysis tar feed is not capable of producing a premium coke when subjected to destructive distillation conditions.

5. The method of claim 1 wherein the untreated pyrolysis tar feed is capable of producing a marginal coke when subjected to destructive distillation conditions.

6. The method of claim 1 wherein the hydrotreated upgraded pyrolysis tar is capable of producing a premium coke when subjected to destructive distillation conditions.

7. The method of claim 1 wherein the hydrotreatment is carried out at a pressure between about 3.4 and 13.8 megapascals, and at a temperature between about 260° C. and 425° C.

8. The method of claim 1 wherein the hydrotreatment is carried out at a pressure between about 5.2 and 10.3 megapascals, and at a temperature between about 290° C. and 370° C.

9. A method for producing premium coke which comprises (a) hydrotreating a pyrolysis tar feed in the presence of an acidic catalyst having at least about 65 micromoles of acid sites per gram of catalyst, wherein the acid sites per gram are measured by the ammonia adsorption/TGA method at about 400° C. after calcination of the catalyst to 500° C., (b) producing hydrogen while hydrotreating the pyrolysis tar, (c) discharging the hydrogen produced in step (b), and (d) subjecting the hydrotreated pyrolysis tar to destructive distillation conditions to produce a coke.

10. The method of claim 9 wherein the catalyst comprises gamma-alumina, halogenated alumina, sulfated zirconia, non-crystalline alumina-silicate or crystalline alumino-silicate.

11. The method of claim 9 wherein the catalyst comprises steam activated gamma-alumina.

12. The method of claim 9 wherein the untreated pyrolysis tar feed in step (a) is not capable of producing a premium coke when subjected to destructive distillation conditions.

13. The method of claim 9 wherein the untreated pyrolysis tar feed in step (a) is capable of producing a marginal coke when subjected to destructive distillation conditions.

14. The method of claim 9 wherein the pressure in step (a) is between about 3.4 and 13.8 megapascals, and the temperature in step (a) is between about 260° C. and 425° C.

15. The method of claim 9 wherein the pressure in step (a) is between about 5.2 and 10.3 megapascals, and the temperature in step (a) is between about 290° C. and 370° C.

* * * * *